US006612972B1

(12) United States Patent
Reichard

(10) Patent No.: US 6,612,972 B1
(45) Date of Patent: Sep. 2, 2003

(54) ADJUSTABLE TENSION EXERCISE DEVICE

(76) Inventor: Richard Reichard, 2 Waterford Prof. Center, Apt 7 B1, York, PA (US) 17402

( * ) Notice: Subject to any disclaimer, the term of this patent is extended or adjusted under 35 U.S.C. 154(b) by 68 days.

(21) Appl. No.: 10/015,227

(22) Filed: Dec. 12, 2001

(51) Int. Cl.[7] ..... A63B 21/00
(52) U.S. Cl. ..... 482/131
(58) Field of Search ..... 482/907, 904, 482/114–116, 118–120, 127, 139; 118/65.1, 65.2; 182/190, 192

(56) References Cited

U.S. PATENT DOCUMENTS 4,560,160 A * 12/1985 Smith
4,659,077 A * 4/1987 Stropkay ..... 482/118
5,399,137 A * 3/1995 Kushner ..... 482/114
5,634,873 A * 6/1997 Carlstrom ..... 482/95
5,795,274 A * 8/1998 Kasbohm ..... 482/120
5,803,209 A * 9/1998 Suzaki ..... 482/120

* cited by examiner

*Primary Examiner*—Jerome Donnelly
(74) *Attorney, Agent, or Firm*—Goldstein & Lavas, P.C.

(57) ABSTRACT

An adjustable tension exercise device that allows a person to stimulate muscles in the arms and torso from their home including a door bracket adapted for coupling with a top edge of the door. A pulley wheel is coupled with the door bracket. The pulley wheel includes an internal portion and an exterior portion. The exterior portion is defined by enlarged inner and outer disks having a small cylinder therebetween. The pulley wheel includes a length of rope positioned between the inner and outer disks and engaged to the small cylinder. The length of rope has opposed free ends suspending from the pulley wheel. The free ends each have a gripping handle secured thereto. An adjustable tension knob is coupled with the door bracket. The tension knob includes an ovoid plate selectively engaged with the interior portion of the pulley wheel. The tension knob includes a turn knob controlling rotation of the ovoid plate.

2 Claims, 3 Drawing Sheets

ADJUSTABLE TENSION EXERCISE DEVICE

BACKGROUND OF THE INVENTION

The invention relates to an adjustable tension exercise device, that allows a person to stimulate muscles in the arms and torso from their home.

Several references show various exercise devices. U. S. Pat. No. 4,109,907 to Zito discloses a weight lifting device comprised of a cord and pulley assembly attached to the top of household door. U.S. Pat. No. 5,176,602 to Roberts discloses an exercise device comprised of a pair of handles, a cord and two pulleys that are attachable to a door. U.S. Pat. No. 4,779,867 to exercise device comprised of an elastic cable with stirrups for attachment to a door. U.S. Pat. No. 4,229,002 to Masters discloses a golf swing training device.

While these units may be suitable for the particular purpose employed, or for general use, they would not be as suitable for the purposes of the present invention as disclosed hereafter.

SUMMARY OF THE INVENTION

It is an object of the invention to produce an adjustable tension exercise device that allows a person to stimulate muscles in the arms and torso from their home including an adjustable tension exercise device that allows a person to stimulate muscles in the arms and torso from their home including a door bracket adapted for coupling with a top edge of the door. The door bracket has an inverted U-shaped configuration defined by opposed front and back vertical segments with a horizontal segment disposed therebetween forming an interior channel for positioning over the top edge of the door. A pulley wheel is coupled with the front vertical segment of the door bracket. The pulley wheel includes an internal portion and an exterior portion. The interior portion is disposed interiorly of the front vertical segment. The exterior portion is disposed exteriorly of the front vertical segment. The exterior portion is defined by enlarged inner and outer disks having a small cylinder therebetween. The pulley wheel includes a length of rope positioned between the inner and outer disks and engaged to the small cylinder. The length of rope has opposed free ends suspending from the pulley wheel. The free ends each have a gripping handle secured thereto. An adjustable tension knob is coupled with the front vertical segment of the door bracket. The tension knob includes an ovoid plate disposed interiorly of the front vertical segment. The ovoid plate is selectively engaged with the interior portion of the pulley wheel. The tension knob includes a turn knob disposed exteriorly of the front vertical segment. The turn knob controls rotation of the ovoid plate.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 2:
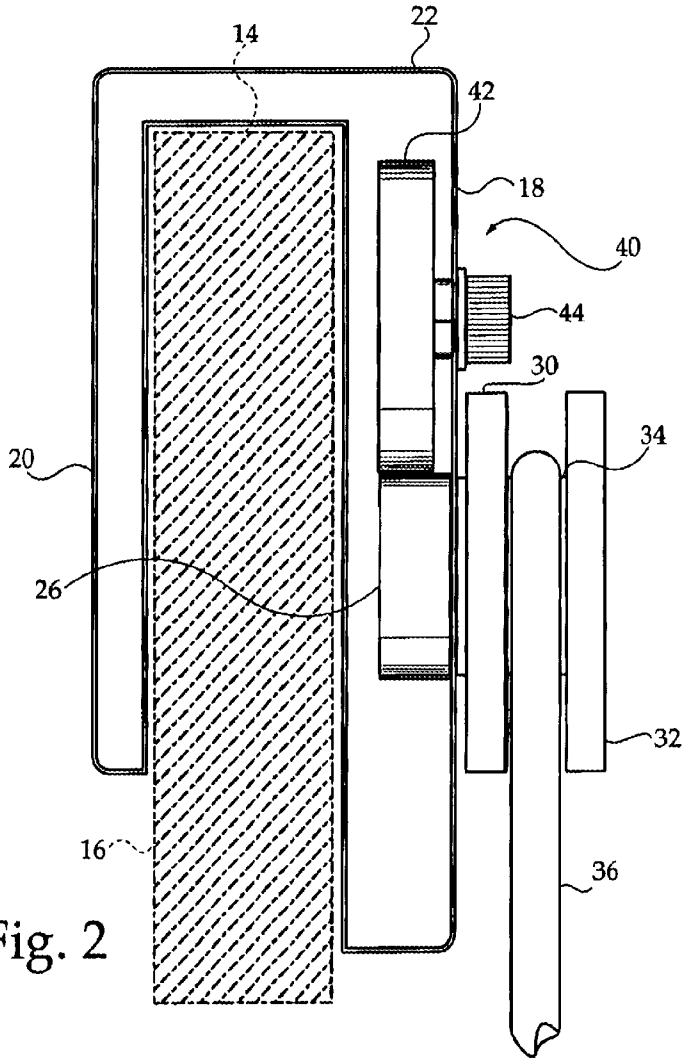
FIG. 2 is a side view of the present invention illustrated attached to a top of a door.
Figure 1:
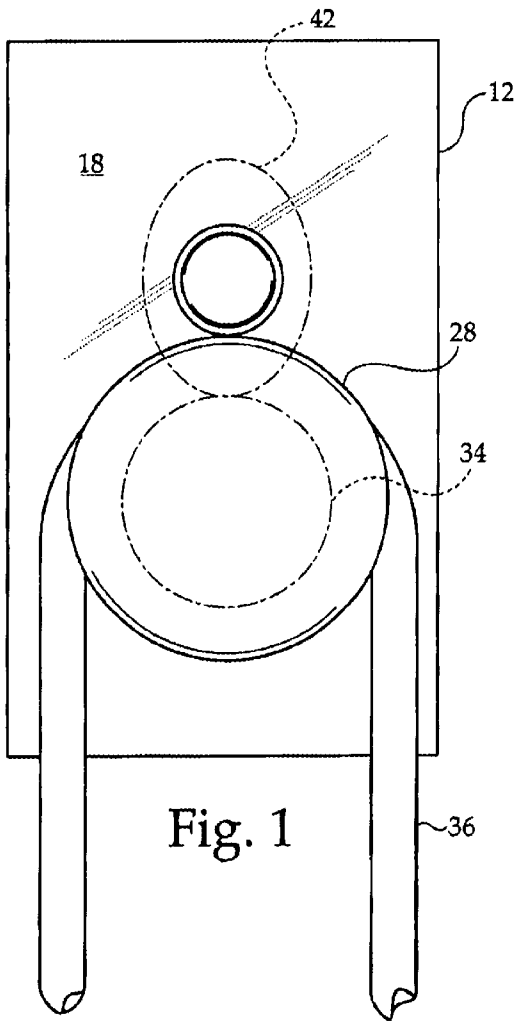
FIG. 1 is a front view of the present invention.
Figure 3:
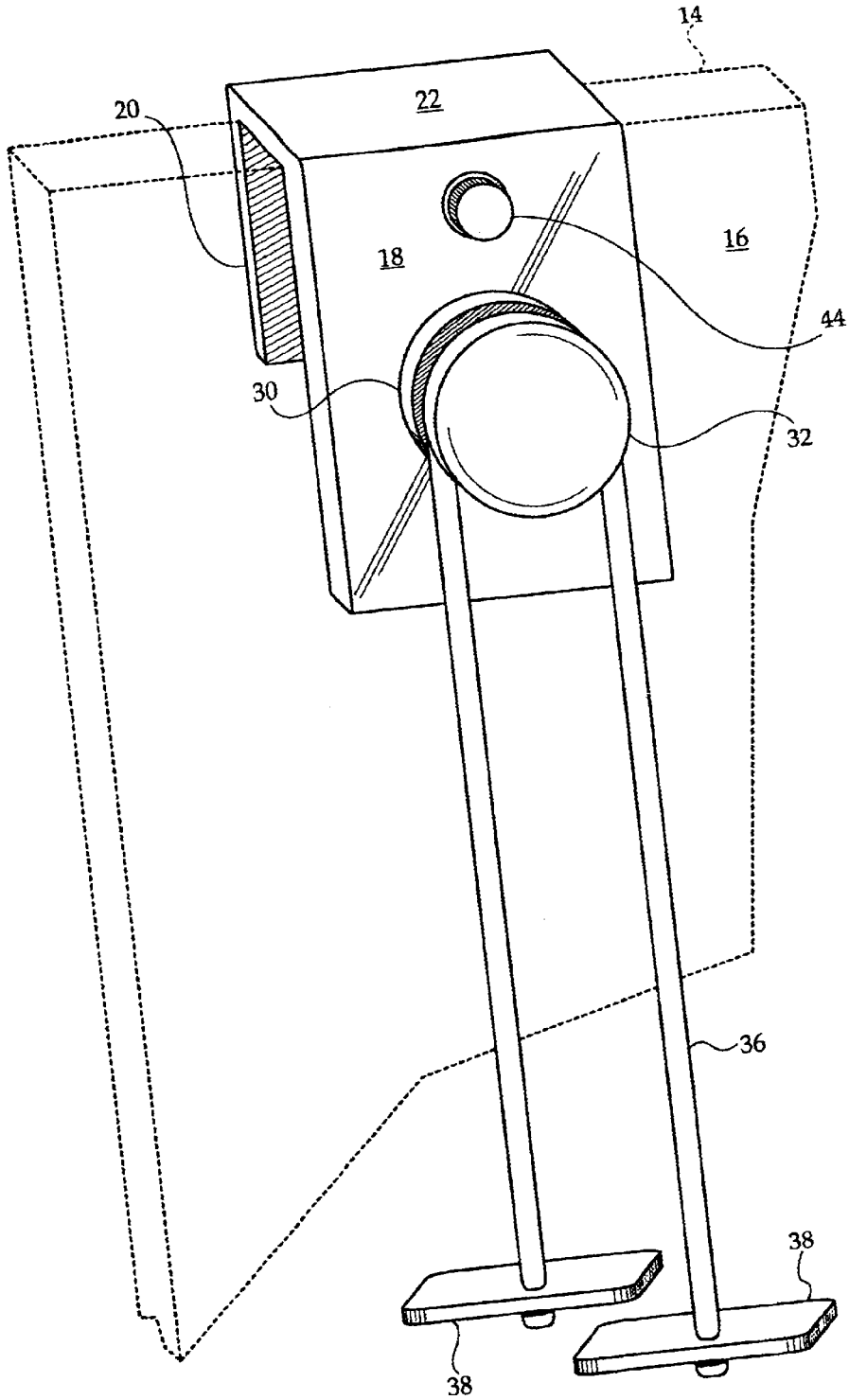
FIG. 3 is a perspective view of the present invention illustrated attached to the top of the door.
Figure 4:
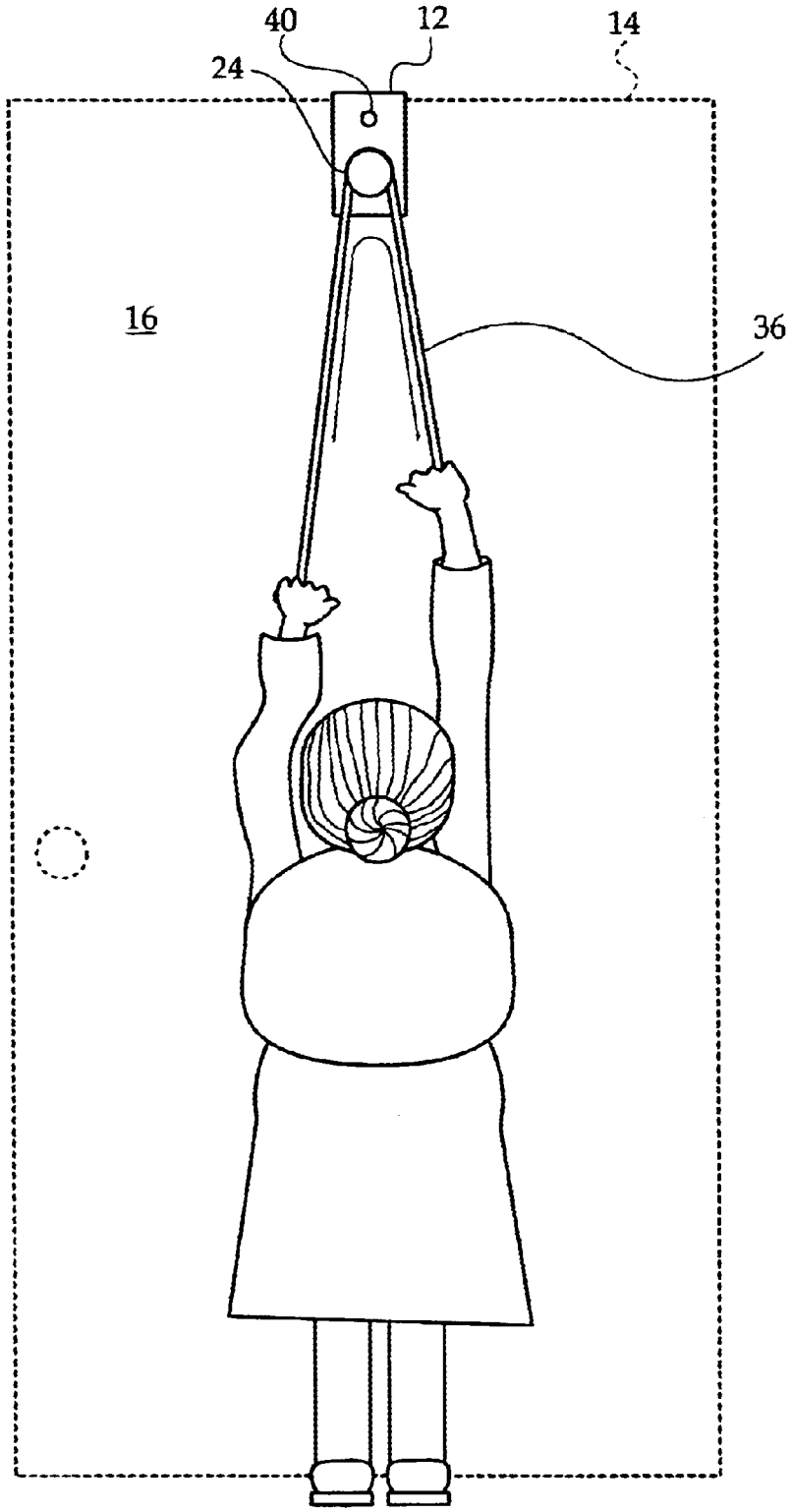
FIG. 4 is a front view of the present invention illustrated in use.

It will be noted in the various figures that the device relates to an adjustable tension exercise device that allows a person to stimulate muscles in the arms and torso from their home. In its broadest context, the device consists of a door bracket, a pulley wheel, and an adjustable tension knob. Such components are individually configured and correlated with respect to each other so as to attain the desired objective.

The door bracket 12 is adapted for coupling with a top edge 14 of the door 16. The door bracket 12 has an inverted U-shaped configuration defined by opposed front and back vertical segments 18,20 with a horizontal segment 22 disposed therebetween forming an interior channel for positioning over the top edge 14 of the door 16. It should be noted that the interior channel could be padded or lined to prevent damage to the door 16.

The pulley wheel 24 is coupled with the front vertical segment 18 of the door bracket 12. The pulley wheel 24 includes an internal portion 26 and an exterior portion 28. The interior portion 26 is disposed interiorly of the front vertical segment 18. The exterior portion 28 is disposed exteriorly of the front vertical segment 18. The exterior portion 28 is defined by enlarged inner and outer disks 30,32 having a small cylinder 34 therebetween. The pulley wheel 24 includes a length of rope 36 positioned between the inner and outer disks 30,32 and engaged to the small cylinder 34. The length of rope 36 has opposed free ends suspending from the pulley wheel. The free ends each have a gripping handle 38 secured thereto. The user simply grasps the gripping handles 38 and pulls back and forth whereby the pulley wheel 24 will rotate in either direction depending on which end of the length of rope 36 is pulled.

The adjustable tension knob 40 is coupled with the front vertical segment 18 of the door bracket 12. The tension knob 40 includes an ovoid plate 42 disposed interiorly of the front vertical segment 18. The ovoid plate 42 is selectively engaged with the interior portion 26 of the pulley wheel 24. The tension knob 40 includes a turn knob 44 disposed exteriorly of the front vertical segment 18. The turn knob 44 controls rotation of the ovoid plate 42. Thus, the orientation of the ovoid plate 42 with respect to the interior portion 26 will determine how much tension is present when the user is pulling on the length of rope 36.

What is claimed is:

1. An adjustable tension exercise device that allows a person to stimulate muscles in the arms and torso from their home, comprising, in combination:

a door bracket adapted for coupling with a top edge of the door, the door bracket having an inverted U-shaped configuration defined by opposed front and back vertical segments with a horizontal segment disposed therebetween forming an interior channel for positioning over the top edge of the door;

a pulley wheel coupled with the front vertical segment of the door bracket, the pulley wheel including an internal portion and an exterior portion, the interior portion being disposed interiorly of the front vertical segment, the exterior portion being disposed exteriorly of the front vertical segment, the exterior portion being defined by enlarged inner and outer disks having a small cylinder therebetween, the pulley wheel including a length of rope positioned between the inner and outer disks and engaged to the small cylinder, the length of rope having opposed free ends suspending from the pulley wheel, the free ends each having a gripping handle secured thereto; and an adjustable tension knob coupled with the front vertical segment of the door bracket, the tension knob including an ovoid plate disposed interiorly of the front vertical segment, the ovoid plate being selectively engaged with the interior portion of the pulley wheel, the tension knob including a turn knob disposed exteriorly of the front vertical segment, the turn knob controlling rotation of the ovoid plate.

2. An adjustable tension exercise device that allows a person to stimulate muscles in the arms and torso from their home, comprising, in combination:

a door bracket adapted for coupling with a top edge of the door;

a pulley wheel coupled with the door bracket, the pulley wheel including an internal portion and an exterior portion, the exterior portion being defined by enlarged inner and outer disks having a small cylinder therebetween, the pulley wheel including a length of rope positioned between the inner and outer disks and engaged to the small cylinder, the length of rope having opposed free ends suspending from the pulley wheel, the free ends each having a gripping handle secured thereto; and an adjustable tension knob coupled with the door bracket, the tension knob including an ovoid plate selectively engaged with the interior portion of the pulley wheel, the tension knob including a turn knob controlling rotation of the ovoid plate.

* * * * *